US006898821B1

(12) United States Patent
Bisbee et al.

(10) Patent No.: US 6,898,821 B1
(45) Date of Patent: May 31, 2005

(54) DEVICE FOR ASH REMOVAL

(76) Inventors: Donald R. Bisbee, 1361 Wall St., Tracy, CA (US) 95376; Derek Bisbee, 1361 Wall St., Tracy, CA (US) 95376

( * ) Notice: Subject to any disclaimer, the term of this patent is extended or adjusted under 35 U.S.C. 154(b) by 346 days.

(21) Appl. No.: 10/234,948

(22) Filed: Sep. 4, 2002

(51) Int. Cl.[7] ..... A47L 9/10
(52) U.S. Cl. ..... 15/353; 15/347
(58) Field of Search ..... 15/301, 314, 347, 15/353

(56) References Cited

U.S. PATENT DOCUMENTS 2,461,815 A * 2/1949 Gill ..... 180/89.11
2,867,231 A * 1/1959 Gerstmann ..... 137/202
4,341,540 A * 7/1982 Howerin ..... 55/307
4,355,434 A * 10/1982 Gongwer ..... 15/327.1
4,476,608 A * 10/1984 Rasmussen ..... 15/353
4,747,178 A * 5/1988 Breitbach ..... 15/339
5,259,087 A * 11/1993 Loveless et al. ..... 15/327.6
5,263,225 A * 11/1993 Winters ..... 15/353
5,311,637 A * 5/1994 Broussard ..... 15/301
6,066,195 A * 5/2000 Ko ..... 96/416

FOREIGN PATENT DOCUMENTS

GB 2156239 * 10/1985

* cited by examiner

*Primary Examiner*—Terrence R. Till

(57) ABSTRACT

A device for ash removal comprising a lid that can be attached to a bucket. A filter panel is positioned within the bucket, the filter panel separates an ash compartment and a coal compartment. A down-spout communicates with the coal compartment and can be connected to conventional vacuum adapters. A vacuum inlet communicates with the ash compartment, the vacuum inlet can be connected to conventional vacuum adapters.

4 Claims, 3 Drawing Sheets

DEVICE FOR ASH REMOVAL

BACKGROUND OF THE INVENTION

1. Field of the Invention

The present invention relates to a device for ash removal for use in connection with a device for receiving ashes. The device for ash removal has particular utility in connection with a container having openings adaptable for accepting a suction source inlet and a suction outlet with an intermediate filter.

2. Description of the Prior Art

Devices for ash removal are desirable for the removal of ash from fireplaces and wooden stoves without sucking the debris directly into a vacuum cleaner. Often the debris from a fireplace includes large pieces of partially burnt wood that could harm a vacuum cleaner. Large debris has a much higher likelihood of containing embers that are still burning, so filtering the output using a paper bag may present a fire hazard. A way was needed to separate the coals from the ash without exposing the coals to flammable paper.

The use of a device for receiving ashes is known in the prior art. For example, U.S. Pat. No. 4,995,137 to Reichborn discloses an appliance for ash removal that includes a vacuum source, an intermediate container and tubes establishing a vacuum path from a fireplace through the intermediate container and to the vacuum source. However, the Reichborn '137 patent does not have a perforated filter panel disposed in an intermediate container separating the fireplace effluent into a coal compartment and an ash compartment thus filtering the effluent going to the vacuum source.

Similarly, U.S. Pat. No. 4,704,764 to Metelko, Jr. discloses a ash disposal device that is a container that has a door disposed in the side of said container so that ash may be shoveled through the door into container, the lid has a vacuum adapter for accepting a vacuum cleaner attachment. However, the Metelko, Jr. '764 patent does not have a perforated filter panel disposed in an intermediate container separating the fireplace effluent into a coal compartment and an ash compartment thus filtering the effluent going to the vacuum source.

Lastly, U.S. Pat. No. 5,311,637 to Broussard discloses a vacuum apparatus for cleaning fireplace flues that has a funnel shaped member for abutting up to a flue, connected by a hose to a collection container that has an adapter for receiving a conventional vacuum hose. However, the Broussard '637 and patent does not have a perforated filter panel disposed in an intermediate container separating the fireplace effluent into a coal compartment and an ash compartment thus filtering the effluent going to the vacuum source.

While the above-described devices fulfill their respective, particular objectives and requirements, the aforementioned patents do not describe a device for ash removal that allows a container having openings adaptable for accepting a suction source inlet and a suction outlet with an intermediate filter. The Reichborn '137, Metelko, Jr. '764, and Broussard '637 patents make no provision for a perforated filter panel disposed in an intermediate container separating the fireplace effluent into a coal compartment and an ash compartment thus filtering the effluent going to the vacuum source.

Therefore, a need exists for a new and improved device for ash removal that can be used for a container having openings adaptable for accepting a suction source inlet and a suction outlet with an intermediate filter. In this regard, the present invention substantially fulfills this need. In this respect, the device for ash removal according to the present invention substantially departs from the conventional concepts and designs of the prior art, and in doing so provides an apparatus primarily developed for the purpose of a container having openings adaptable for accepting a suction source inlet and a suction outlet with an intermediate filter.

SUMMARY OF THE INVENTION

In view of the foregoing disadvantages inherent in the known types of a device for receiving ashes now present in the prior art, the present invention provides an improved device for ash removal, and overcomes the above-mentioned disadvantages and drawbacks of the prior art. As such, the general purpose of the present invention, which will be described subsequently in greater detail, is to provide a new and improved device for ash removal and method which has all the advantages of the prior art mentioned heretofore and many novel features that result in a device for ash removal which is not anticipated, rendered obvious, suggested, or even implied by the prior art, either alone or in any combination thereof.

To attain this, the present invention essentially comprises a device for ash removal comprising a lid that can be attached to a bucket. A filter panel is positioned within the bucket, the filter panel separates an ash compartment and a coal compartment. A down-spout communicates with the coal compartment and can be connected to conventional vacuum adapters. A vacuum inlet communicates with the ash compartment, the vacuum inlet can be connected to conventional vacuum adapters.

There has thus been outlined, rather broadly, the more important features of the invention in order that the detailed description thereof that follows may be better understood and in order that the present contribution to the art may be better appreciated.

The invention may also include a lid seal, latches, a filter seal, a vacuum hose and a handle. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved device for ash removal that has all of the advantages of the prior art a device for receiving ashes and none of the disadvantages.

It is another object of the present invention to provide a new and improved device for ash removal that may be easily and efficiently manufactured and marketed.

An even further object of the present invention is to provide a new and improved device for ash removal that has a low cost of manufacture with regard to both materials and labor, and which accordingly, is then susceptible of low prices of sale to the consuming public, thereby making such device for ash removal economically available to the buying public.

Still another object of the present invention is to provide a new device for ash removal that provides in the apparatuses and methods of the prior art some of the advantages thereof, while simultaneously overcoming some of the disadvantages normally associated therewith.

Even still another object of the present invention is to provide a device for ash removal for easing the cleaning of fireplaces.

Still yet another object of the present invention is to provide a device for ash removal for sucking up ashes and coals with the debris being automatically collected in separate compartments in a dust free manner.

Yet another object of the present invention is to provide a device for ash removal that is lightweight, compact and easy to move and store.

Another object of the present invention is to provide a device for ash removal that is a timesaving alternative to cleaning a fireplace with a broom and shovel.

Lastly, it is an object of the present invention to provide a new and improved device or ash removal that allows the user greater control and maneuverability while cleaning fireplaces.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
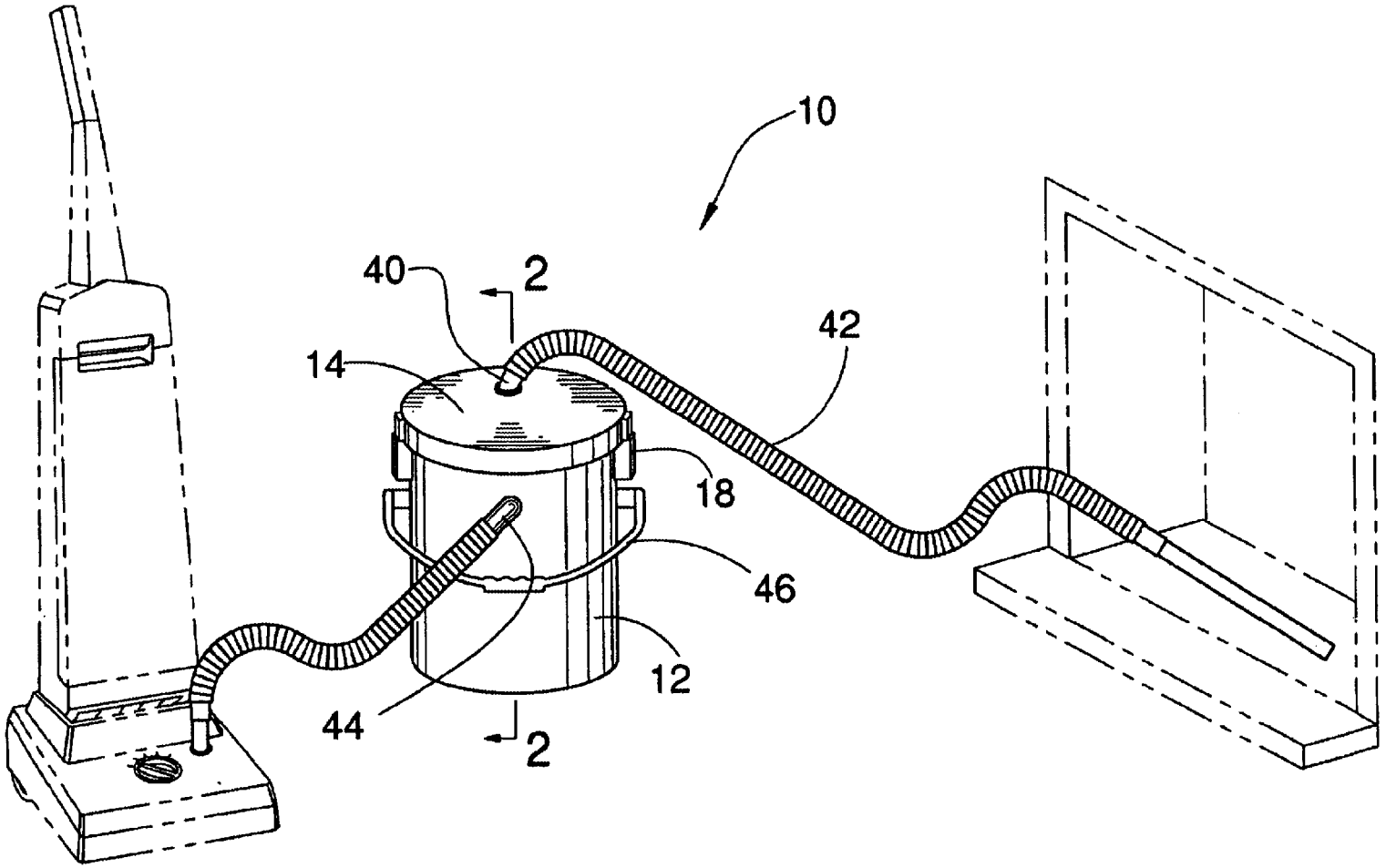
FIG. 1 is a front perspective view of the preferred embodiment of the device for ash removal constructed in accordance with the principles of the present invention.
Figure 2:
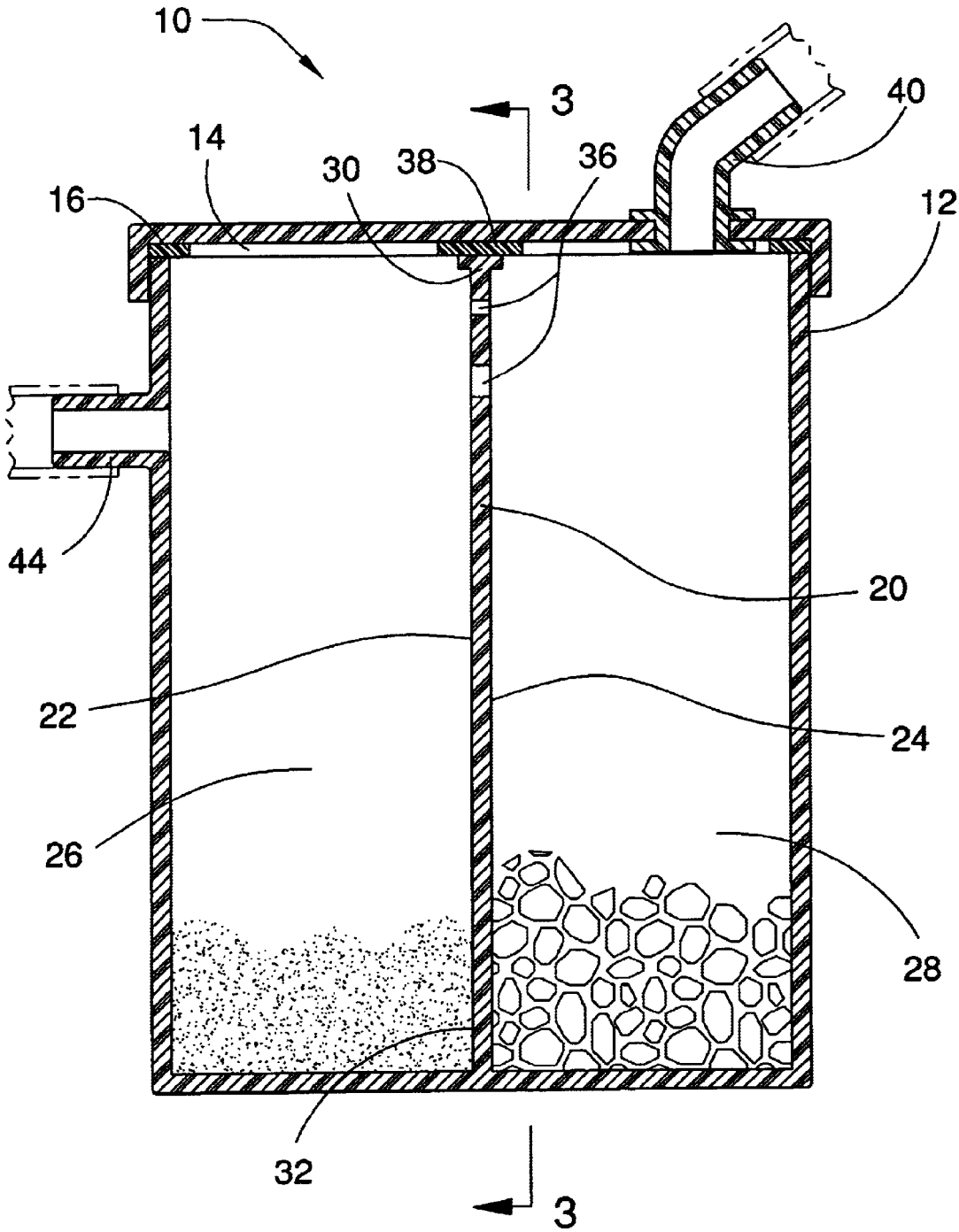
FIG. 2 is a section 2—2 view of FIG. 1 of the device for ash removal of the present invention.
Figure 3:
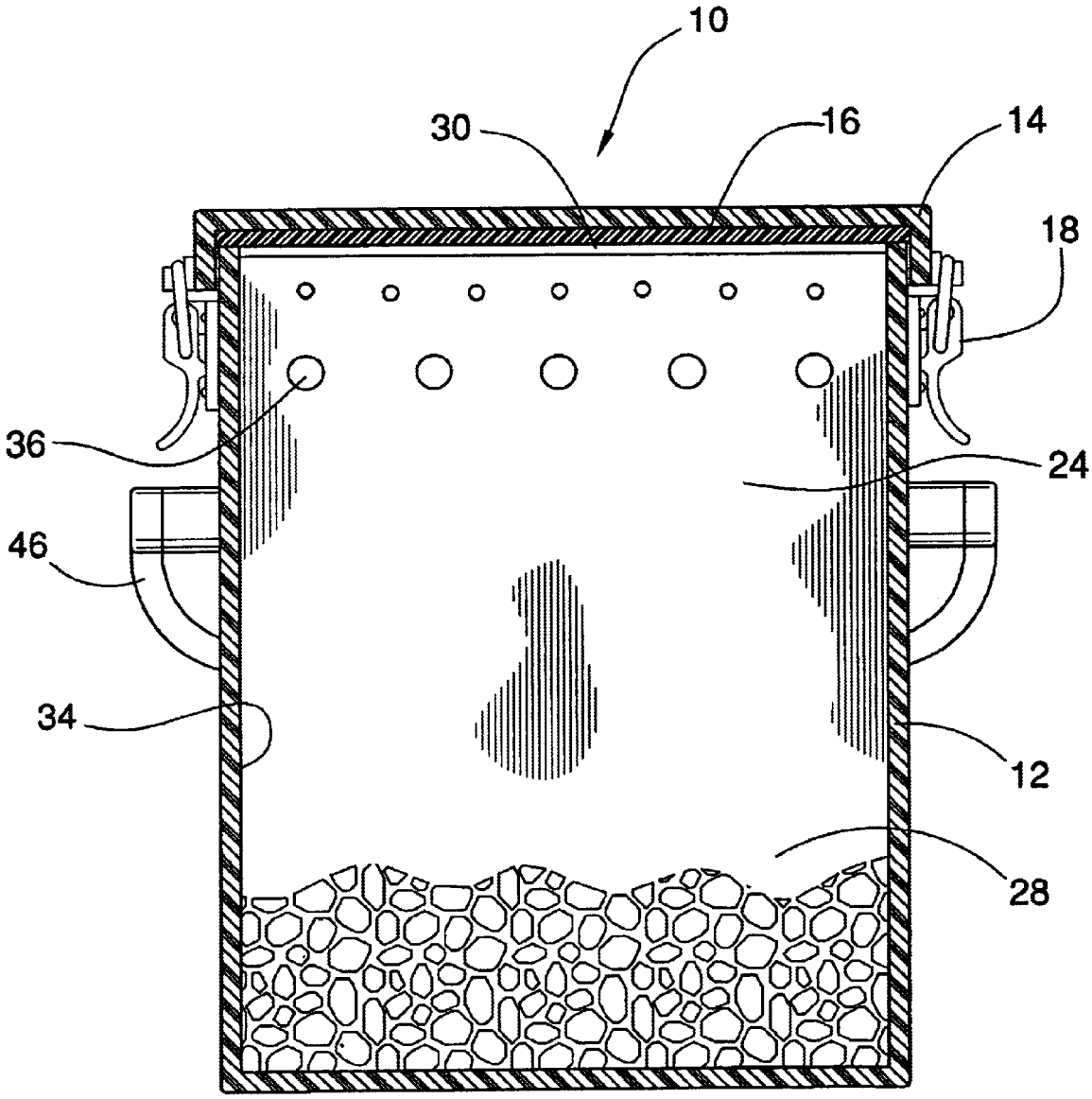
FIG. 3 is a section 3—3 view of FIG. 2 of the device for ash removal of the present invention.

Referring now to the drawings, and particularly to FIGS. 1–3, a preferred embodiment of the device for ash removal of the present invention is shown and generally designated by the reference numeral 10.

In FIG. 1, a new and improved device for ash removal 10 of the present invention for a container having openings adaptable for accepting a suction source inlet and a suction outlet with an intermediate filter is illustrated and will be described. More particularly, the device for ash removal 10 has a bucket 12 that in this instance is a five-gallon conventional bucket that is approximately fifteen inches tall and twelve inches in diameter. A lid 14 is attached to the bucket 12. A set of latches 18 are attached to the lid 14 for securing the lid 14 to the bucket 12, or, optionally, a friction-fit lid may be employed. A down-spout 40 is attached to the bucket 12. A vacuum hose 42 is adapted for connection to the down-spout 40. A vacuum inlet 44 is attached to the bucket 12 opposite of the down-spout 40. The vacuum inlet 44 is adapted for connection to conventional vacuum adapters. A handle 46 is rotatably attached to the bucket 12.

In FIG. 2 the device for ash removal 10 is shown in section view. The lid 14 is attached to the bucket 12. A lid seal 16 is attached to the lid 14 to provide an airtight seal between the bucket 12 and the lid 14. A filter panel 20 is positioned within the bucket 12, the filter panel 20 having two opposite sides, a filter panel ash compartment side 22 and a filter panel coal compartment side 24. The filter panel ash compartment side 22 and the bucket 12 facing the filter panel ash compartment side 22 defining an ash compartment 26. The filter panel coal compartment side 24 and the bucket 12 facing the filter panel coal compartment side 24 defines a coal compartment 28. The filter panel 20 has a top edge 30 and a bottom edge 32. The filter panel 20 is rigid and has a plurality of holes 36 adjacent to the top edge 30. The lid has a tight frictional fit; optionally, a seal may be employed to ensure an airtight seal between the filter panel top edge 30 and the lid 14. The down-spout 40 vents to the coal compartment 28 and is attached to the bucket 12. The down-spout 40 is adapted for connection to conventional vacuum adapters. The vacuum inlet 44 vents to the ash compartment 26 and is attached to the bucket 12. The vacuum inlet 44 is adapted for connection to conventional vacuum adapters.

In FIG. 3 the device for ash removal 10 is shown in section view. The lid 14 is attached to the bucket 12. The set of latches 18 are attached to the lid 14 for securing the lid 14 to the bucket 12. The handle 46 is rotatably attached to the bucket 12. The lid seal 16 is attached to the lid 14 to provide an airtight seal between the bucket 12 and the lid 14. The filter panel 20 is positioned within the bucket 12. The filter panel coal compartment side 24 and the bucket 12 facing the filter panel coal compartment side 24 defines the coal compartment 28. The filter panel 20 has the top edge 30, the bottom edge 32 and two opposite side edges 34. The filter panel 20 is rigid and has the plurality of holes 36 adjacent to the top edge 30.

In use, it can now be understood that ash from the fireplace is sucked up the vacuum hose 42 which is connected to the down-spout 40 venting into the coal compartment 28. The filter panel 20 allows only the ash through to the ash compartment 26. The ash compartment 26 vents to the vacuum inlet 44 which is connected to a vacuum cleaner.

While a preferred embodiment of the device for ash removal has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal may be used instead of the plastic described. Also, the perforated filter may also be made plastic, metal, or similar material. And although a container having openings adaptable for accepting a suction source inlet and a suction outlet with an intermediate filter have been described, it should be appreciated that the device for ash removal herein described is also suitable for collecting any material that may harm a vacuum cleaner.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A device for ash removal comprising:

a lid adapted to be attached to a bucket;

a filter panel adapted to positionable within said bucket, said filter panel having two opposite sides, a filter panel ash compartment side and a filter panel coal compartment side, said filter panel ash compartment side and said bucket facing said filter panel ash compartment side defining an ash compartment, said filter panel coal compartment side and said bucket facing said filter panel coal compartment side defining a coal compartment;

a down-spout ventilatingly communicating with said coal compartment, said down-spout adapted for connection to conventional vacuum adapters;

a vacuum inlet ventilatingly communicating with said ash compartment, said vacuum inlet adapted for connection to conventional vacuum adapters; and a filter seal attached to said filter panel to provide an airtight seal between said filter panel and said lid.

2. A device for ash removal comprising:

a bucket, said bucket being a conventional five gallon type;

a lid adapted to be attached to said bucket;

a filter panel adapted to be positionable within said bucket, said filter panel having two opposite sides, a filter panel ash compartment side and a filter panel coal compartment side, said filter panel ash compartment side and said bucket facing said filter panel ash compartment side defining an ash compartment, said filter panel coal compartment side and said bucket facing said filter panel coal compartment side defining a coal compartment;

a down-spout ventilatingly communicating with said coal compartment, said down-spout adapted for connection to conventional vacuum adapters;

a vacuum inlet ventilatingly communicating with said ash compartment, said vacuum inlet adapted for connection to conventional vacuum adapters;

a lid seal attached to said lid to provide an airtight seal between said bucket and said lid; and a filter seal attached to said filter panel to provide an airtight seal between said filter panel and said lid.

3. The device for ash removal of claim 2 wherein:

said filter panel has a top edge, a bottom edge and two opposite side edges, said filter panel being rigid and having a plurality of holes adjacent to said top edge.

4. A device for ash removal comprising:

a conventional five gallon bucket;

a lid adapted to be attached to said bucket;

a lid seal attached to said lid to provide an airtight seal between said bucket and said lid;

a set of latches attached to said lid for securing said lid to said bucket;

a filter panel adapted to be positionable within said bucket, said filter panel having two opposite sides, a filter panel ash compartment side and a filter panel coal compartment side, said filter panel ash compartment side and said bucket facing said filter panel ash compartment side defining an ash compartment, said filter panel coal compartment side and said bucket facing said filter panel coal compartment side defining a coal compartment, said filter panel has a top edge, a bottom edge and two opposite side edges, said filter panel being rigid and having a plurality of holes adjacent to said top edge;

a filter seal attached to said filter panel to provide an airtight seal between said filter panel and said lid;

a down-spout ventilatingly communicating with said coal compartment, said down-spout adapted for connection to conventional vacuum adapters, said down-spout is attached to said lid;

a vacuum hose adapted to connection to said down-spout;

a vacuum inlet ventilatingly communicating with said ash compartment, said vacuum inlet adapted for connection to conventional vacuum adapters, said vacuum inlet is attached to said bucket; and a handle rotatably attached to said bucket.

* * * * *